US005206107A

United States Patent [19]

Pearlstine

[11] Patent Number: 5,206,107

[45] Date of Patent: Apr. 27, 1993

[54] SILOXANE SURFACTANTS AS LIQUID DEVELOPER ADDITIVES

[75] Inventor: Kathryn A. Pearlstine, Wilmington, Del.

[73] Assignee: Xerox Corporation, Stamford, Conn.

[21] Appl. No.: 814,515

[22] Filed: Dec. 30, 1991

[51] Int. Cl.[5] ..... G03G 9/135

[52] U.S. Cl. ..... 430/115

[58] Field of Search ..... 430/114, 115

[56] References Cited

U.S. PATENT DOCUMENTS

| | | | |
|---|---|---|---|
| 3,053,688 | 9/1962 | Grieg | 117/37 |
| 3,150,976 | 9/1964 | Johnson | 96/1 |
| 3,579,451 | 5/1971 | Sciambi | 252/62.1 |
| 3,852,208 | 12/1974 | Nagashima et al. | 252/62.1 |
| 3,933,664 | 1/1976 | Nagashima et al. | 252/62.1 |
| 3,939,087 | 2/1976 | Vijayendran et al. | 252/62.1 |
| 4,019,911 | 4/1977 | Vijayendran et al. | 106/23 |
| 4,314,013 | 2/1982 | Chang | 430/37 |
| 4,430,408 | 2/1984 | Sitaramiah | 430/106.6 |
| 4,476,210 | 10/1984 | Croucher et al. | 430/114 |
| 4,524,119 | 6/1985 | Luly et al. | 430/108 |
| 4,702,985 | 10/1987 | Larson | 430/115 |
| 4,707,429 | 11/1987 | Trout | 430/115 |
| 4,737,432 | 4/1988 | Tanaka et al. | 430/110 |
| 4,740,444 | 4/1988 | Trout | 430/137 |
| 4,760,009 | 7/1988 | Larson | 430/137 |
| 4,762,764 | 8/1988 | Ng et al. | 430/115 |
| 4,770,968 | 9/1988 | Georges et al. | 430/108 |
| 4,780,388 | 10/1988 | Larson | 430/137 |
| 4,820,604 | 9/1989 | Manca et al. | 430/110 |
| 4,876,169 | 10/1989 | Gruber et al. | 430/110 |
| 4,923,778 | 5/1990 | Blair et al. | 430/137 |
| 4,945,020 | 7/1990 | Kempf et al. | 430/49 |
| 4,960,666 | 10/1990 | Weagley et al. | 430/114 |
| 5,019,477 | 5/1991 | Felder | 430/115 |
| 5,026,621 | 6/1991 | Tsubuko et al. | 430/109 |
| 5,030,535 | 7/1991 | Drappel et al. | 430/116 |
| 5,034,299 | 7/1991 | Houle et al. | 430/115 |

*Primary Examiner*—John Goodrow
*Attorney, Agent, or Firm*—Oliff & Berridge

[57] ABSTRACT

A liquid developer contains a liquid dispersion medium, marking particles, a polymeric surfactant, an optional colorant, and an optional charge control agent. The polymeric surfactant may be a siloxane surfactant, preferably a siloxane-alkene oxide block copolymer. To prepare the liquid developer, the surfactant may be added as a post additive to previously-formed developer.

17 Claims, No Drawings

SILOXANE SURFACTANTS AS LIQUID DEVELOPER ADDITIVES

The present invention is generally directed to liquid developers. More specifically, the present invention relates to a liquid developer having a siloxane surfactant as an additive, and to a method for preparing a liquid developer comprising a toner and a siloxane surfactant.

BACKGROUND OF INVENTION

In an electrostatographic imaging process such as, for example, xerography, a xerographic plate containing a photoconductive insulating layer is imaged by uniformly electrostatically charging its surface followed by exposing it to a pattern of activating electromagnetic radiation such as light to selectively dissipate the charge in illuminated areas of the photoconductive member. This process forms an electrostatic latent image corresponding to the pattern of activating electromagnetic radiation. Alternatively, instead of latent image formation by uniformly charging a photoconductive layer and then exposing the layer to a light-and-shadow image, one may form the latent image by directly charging a dielectric layer in image configuration. The electrostatic latent image may then be developed with a developer composition containing charged marking particles. The charged particles will normally be attracted to those areas of the layer which retain a charge, thereby forming a toner image corresponding to the latent electrostatic image. This powder image may then be transferred to a support surface such as paper. The transferred image may be permanently affixed to the support surface as by heat. Other suitable fixing means such as solvent or overcoating treatment may be substituted for the foregoing heat fixing step.

To convert latent electrostatic images into visible images, a toner is generally used consisting of minute particles of a colored resin material which possesses definite triboelectric properties. Depending on the electrostatic charge the resin particles are either attracted and deposited on the charged areas of the latent image, or are repelled by the charged areas and deposited on the discharged areas. Such an operation is called the development of the latent electrostatic image.

In the electrostatographic process, liquid electrostatic developers are commonly used. Conventional commercial liquid developers comprise a dispersion of pigments in a liquid hydrocarbon. Once the electrostatic latent image is formed on an imaging member, it is transported through a bath of the liquid developer. When in contact with the liquid developer, the charged pigment particles in the liquid developer migrate to the electrostatic latent image and deposit thereon in conformance with the image. The imaging member may then be withdrawn from the liquid developer bath with the marking particles adhering to the electrostatic latent image in image configuration. A thin film of residual developer normally remains on the surface of the imaging member.

U.S. Pat. Nos. 4,762,764 to Ng et al. and 4,476,210 to Croucher et al. disclose a liquid developer comprising an amphipathic stabilizer polymer irreversibly anchored to a thermoplastic resin core of marking particles. The stabilizer has a soluble polymer backbone with an insoluble anchoring chain grafted onto the polymer backbone. The stabilizer may comprise an AB or ABA type block copolymer. The block copolymers may include siloxanes. The procedure for preparing the liquid developer comprises the steps of (1) preparation of the amphipathic stabilizer; (2) non-aqueous dispersion polymerization of the core monomer in the presence of the amphipathic stabilizer to provide stabilized particles; (3) dyeing of the non-aqueous dispersion particles; and (4) negatively charging the particles.

U.S. Pat. No. 3,579,451 to Sciambi discloses a stable, dry developer composition concentrate comprising silicone intermediate resin and a cross-linking promoting catalyst. The dry concentrate can be made into a liquid concentrate. The silicone intermediate resin component is a toluene- or xylene-soluble, lower alkyl and/or phenyl substituted, cross-linkable siloxane resin. The liquid developer composition concentrate is prepared by (1) heating a mixture of silicone intermediate resin and a cross-linking promoting catalyst suspended in an aromatic organic carrier liquid; (2) admixing the resin-catalyst mixture with an insoluble solid pigment; (3) milling the resin-catalyst mixture and pigment together in a grinding mill; (4) evaporating the milled materials to dryness; and (5) milling the dry concentrate with an organic carrier liquid to produce a liquid developer concentrate containing submicron-sized catalyst particles.

U.S. Pat. No. 4,737,432 to Tanaka et al. discloses a positively chargeable toner and a dry developer comprising positively chargeable fine silica powder. The silica powder may be treated to enhance hydrophobicity with another silane coupling agent or with an organic silicon compound, including such agents as hexamethyldisiloxane, 1,3-divinyltetramethyldi-siloxane, 1,3-diphenyltetramethyldisiloxane, and dimethylpolysiloxane having 2 to 12 siloxane units per molecule and containing each on hydroxyl group bonded to Si at the terminal units.

U.S. Pat. Nos. 3,939,087 and 4,019,911, both to Vijayendran et al., disclose liquid toner compositions comprising a silane treated fumed silica. The silane treated fumed silica is treated with an organosilicon compound in which some of the bonds of a silane linkage are substituted by saturated or unsaturated hydrophobic organic groups.

U.S. Pat. No. 4,876,169 to Gruber et al. describes the use of siloxanes, in particular polydialkyl and polydimethyl siloxanes, incorporated in the backbone of a polymer resin in a dry toner or developer composition in conjunction with a release fluid additive which enables the toner to be free flowing and the toner particles not to agglomerate.

A need continues to exist for a liquid developer which provides good transfer efficiency, high resolution, dot range, print reproducibility, and print uniformity.

SUMMARY OF THE INVENTION

It is an object of the invention to provide a liquid developer with improved transfer efficiency of the developed image.

It is a further object of the invention to provide a liquid developer which provides high resolution, dot range, print reproducibility and print uniformity.

It is yet another object of the invention to provide a liquid developer wherein a surfactant can be added without the need to remake the toner (i.e., as a post additive.)

These objects and others are accomplished by a liquid developer of the invention which comprises a toner, a liquid dispersion medium and a polymeric siloxane surfactant. Preferably, the siloxane surfactant comprises a siloxane-alkene oxide block copolymer.

DETAILED DESCRIPTION OF PREFERRED EMBODIMENTS

A liquid developer of the present invention comprises an electrostatic toner which may be comprised of an insulating organic liquid dispersion medium, a polymeric siloxane surfactant, charged marking particles with a thermoplastic resin core, an optional colorant, and an optional charge control agent. The liquid developer of the invention may be used with both encapsulated and non-encapsulated toners.

It is a particular advantage of the present invention that the polymeric surfactant may be added subsequent to the preparation of the toner, i.e., as a post additive, and thus in a manner that does not require the toner to be remade in order to employ this additive.

The presence of a siloxane surfactant enables excellent transfer of an image. The polymeric surfactant of the present invention is a siloxane, and preferably a siloxane-alkene oxide block polymer. Examples of the polysiloxanes selected for the surfactant polymers of the present invention include those of the following formula:

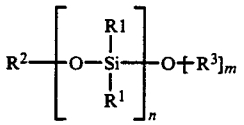

wherein $R^1$ is an alkyl or aryl of to 10 carbon atoms;

$R^2$ is H or alkyl of to 10 carbon atoms terminated with OH;

$R^3$ is

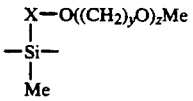

wherein

X is an alkyl of 1 to 50 carbon atoms;

n represents the number of repeating units and is a whole integer from 1 to 200;

m represents the number of repeating units and is a whole integer from 1 to 200;

y is an integer from 1 to 10, most preferably 2 to 3; and z is an integer from 1 to 30.

A preferred block polymer is dimethylsiloxaneethylene oxide.

The surfactant is employed in a concentration ranging from 10 to 1000 mg per gram of toner solids, and more preferably in the range of 100 to 500 mg per gram of toner solids.

The liquid developers of the invention may be made with any suitable dispersion medium. Nonpolar liquids useful as a dispersion medium are, preferably, branched-chain aliphatic hydrocarbons. These include, for example, Isopar ®-G, Isopar ®-H, Isopar ®-K, Isopar ®-L, Isopar ®-M, and Isopar ®-V. These hydrocarbon liquids are narrow cuts of isoparaffinic hydrocarbon fractions with extremely high levels of purity. They are substantially odorless, possessing a very mild paraffinic odor. They have excellent odor stability and are all manufactured by the Exxon Corporation. High-purity normal paraffinic liquids, Norpar ®12, Norpar ®13 and Norpar ®15 (Exxon Corporation) may also be used. These hydrocarbon liquids have flash points ranging from 69° C.–118° C. All of these dispersion medium nonpolar liquids have an electrical volume resistivity in excess of $10^9$ ohm centimeters and a dielectric constant below 3.0. The vapor pressures at 25° C. are less than 10 Torr. While Isopar ® and Norpar ® are preferred dispersant nonpolar liquids, the essential characteristics of all suitable dispersant nonpolar liquids are the electrical volume resistivity and the dielectric constant. In addition, a feature of the dispersion medium nonpolar liquids is a Kauri-butanol value less than 30, preferably in the vicinity of 27 or 28 as determined by ASTM D 1133. The ratio of thermoplastic resin to dispersion medium nonpolar liquid is such that the combination of ingredients is fluid at the working temperature. In preferred embodiments, the toner particles are present in an amount between about 0.1 to about 15% by weight, preferably 0.3 to 3.0, and more preferably a 0.5 to 2.0 weight percent with respect to the total liquid developer.

The marking particles which are dispersed in the dispersion medium in the practice of the present invention comprise a synthetic resin core which is insoluble in the dispersion liquid. The marking particles may contain a colorant, and/or may contain a charge control agent such as, for example, one selected from the group consisting of polybutene succinimides; lecithin; basic barium petroleum sulfonate; neutral barium petroleum sulfonate; calcium petroleum sulfonate; metallic soap charge directors such as aluminum tristearate, aluminum distearate, barium, calcium, lead and zinc stearates; cobalt, manganese, lead and zinc linoleates; aluminum, calcium and cobalt octoates; calcium, cobalt, manganese, iron, lead and zinc naphthenates; calcium, cobalt, manganese, lead and zinc resinates; and mixtures thereof.

Suitable toners and methods of manufacturing them are disclosed in U.S. Pat. No. 5,034,299, which is hereby incorporated by reference.

Any suitable thermoplastic resin may be used in the marking particle. The resins employed in this invention should have the preferred characteristics of (1) being able to disperse the colorant; (2) being substantially insoluble in the dispersant liquid at temperatures below 40° C. (so that the resin will not dissolve or solvate in storage); (3) being able to be ground to form particles between 0.1 μm and 5 μm in diameter; (4) being able to form a particle (average by area) of less than 10 μm, a particle size range of 0.01 to less than 10 μm, and about 30 μm average particle size; and (5) being able to fuse at temperatures in excess of 70° C. An important advantage of this invention lies in the fact that known commercial resins may be used without modification by incorporating a siloxane surfactant into the dispersion medium. Suitable resins include poly(methyl acrylate) poly(methyl methacrylate), poly(ethyl methacrylate), poly(hydroxy-ethyl methacrylate), poly(2-ethoxyethyl methacrylate), poly(butoxy ethoxyethyl methacrylate), poly(dimethyl amino ethyl acrylate), poly(acrylic acid), poly(methacrylic acid), poly(acrylamide), poly(methacrylamide), poly(acrylonitrile), poly(vinyl chloride) and poly(ureidoethyl vinyl ether). Other useful thermoplastic resins or polymers include ethylene vinyl acetate (EVA) copolymers (Elvax resins, E. I. du Pont de Nemours and Company, Wilmington, Del.), copolymers of ethylene and an alpha-betaethylenically unsaturated acid selected from the group consisting of acrylic acid and methacrylic acid, copolymers of ethylene (80 to 99.9%)/acrylic or methacrylic acid (20 to 0%)/alkyl(C1 to C5) ester of methacrylic or acrylic acid (0 to 20%), polyethylene, polystyrene, isotactic polypropylene (crystalline), and ethylene ethyl acrylate series sold under the trademark Bakelite® DPD 6169, DPDA 6182 Natural and DTDA 9169 Natural and DQDA 6832 Natural 7 also sold by Union Carbide Corp; Surlyn® ionomer resin by E. I. du Pont de Nemours and Company, Wilmington, Del., or blends thereof, polyester, polyvinyl toluene, polyamides, styrene/butadiene copolymers and epoxy resins.

Other resins include acrylic resins, such as a copolymer of acrylic or methacrylic acid (optional but preferred) and at least one alkyl ester of acrylic or methacrylic acid wherein alkyl is 1-20 carbon atoms, e.g., methyl acrylate (50-90%)/methacrylic acid (0-20%)/ethylhexyl methacrylate (10-50%); and other acrylic resins including Elvacite® acrylic resins, E. I. du Pont de Nemours and Company, Wilmington, Del., or blends of resins, polystyrene, and polyethylene.

The liquid developer of this invention may include a charge control agent (charge director) to impart a charge to the marking particles sufficient to enable the particles to undergo electrophoresis in an electric field through the insulating organic liquid dispersion medium. The charge control agent should be soluble in the dispersion medium but adsorbable at the particle-fluid interface. It has been found that the interaction of the colorant with the resin affects both the sign and the magnitude of the electrostatic charge. Exemplary charge control agents in the developers of this invention may include ionic and zwitterionic charge directors such as those discussed above.

The invention also is directed to a method of preparing a liquid electrostatic developer comprising a siloxane component, comprising the steps of preparing a liquid electrostatic developer base, and subsequently adding a siloxane surfactant to the electrostatic developer base.

The electrostatic liquid developers of the invention can be obtained from known commercial sources or can be prepared by a variety of processes commonly known in the art. For example, into a suitable mixing or blending vessel, e.g., attritor, heated ball mill, heated vibratory mill such as a Sweco Mill manufactured by Sweco Co., Los Angeles, Calif., equipped with particulate media, for dispersing and grinding, Ross double planetary mixer manufactured by Charles Ross and Son, Hauppauge, N.Y., etc., or two roll heated mill (no particulate media necessary) are placed at least one of the thermoplastic resin and nonpolar liquid described above. Generally, the resin, nonpolar liquid and optional colorant are placed in the vessel prior to starting the dispersing step. Optionally the colorant can be added after homogenizing the resin and the nonpolar liquid. Polar additives useful for improving transfer efficiency and enhancing image quality can also be present in the vessel, e.g., up to 100% based on the weight of nonpolar liquid. The dispersing step is generally accomplished at elevated temperature, i.e., the temperature of ingredients in the vessel being sufficient to plasticize and liquefy the resin but being below that at which the nonpolar liquid or polar additive, if present, degrades and the resin and or colorant decomposes. A preferred temperature range is 80° C. to 120° C. Other temperatures outside this range may be suitable, however, depending on the particular ingredients used. The presence of the irregularly moving particulate media in the vessel is preferred to prepare the dispersion of toner particles. Other stirring means can be used as well, however, to prepare dispersed toner particles of proper size, configuration and morphology. Useful particulate media include particulate materials (e.g., spherical, cylindrical, etc.) selected from the group consisting of stainless steel, carbon steel, alumina, ceramic, zirconia, silica and sillimanite. Carbon steel particulate media are particularly useful when colorants other than black are used. A typical diameter range for the particulate media is in the range of 0.04 to 0.5 inch (1.0 to approximately 13 mm).

After dispersing the ingredients in the vessel, with or without a polar additive present, until the desired dispersion is achieved (typically 1 hour with the mixture being fluid), the dispersion is cooled, e.g., in the range of 0° C. to 50° C. Cooling may be accomplished, for example, in the same vessel, such as the attritor, while simultaneously grinding with particulate media to prevent the formation of a gel or solid mass; without stirring to form a gel or solid mass, followed by shredding the gel or solid mass and grinding, e.g., by means of particulate media; or with stirring to form a viscous mixture and grinding by means of particulate media. Additional liquid may be added at any step during the preparation of the liquid electrostatic developer to facilitate grinding or to dilute the developer to the appropriate percent solids needed for toning. The additional liquid may be nonpolar liquid, polar additive, or combinations thereof. Cooling is accomplished by means known to those skilled in the art and is not limited to cooling by circulating cold water or a cooling material through an external cooling jacket adjacent the dispersing apparatus or permitting the dispersion to cool to ambient temperature. The resin precipitates out of the dispersant during the cooling. Toner particles of average particle size (by area) of less than 10 μm are formed by grinding for a relatively short period of time.

After cooling and separating the dispersion of toner particles from the particulate media, if present, by means known to those skilled in the art, it is possible to reduce the concentration of the toner particles in the dispersion, impart an electrostatic charge of predetermined polarity to the toner particles, or a combination of these variations. The concentration of the toner particles in the dispersion is reduced by the addition of additional nonpolar liquid as described previously above. The dilution is normally conducted to reduce the concentration of toner particles to a working concentration.

One or more charge director compounds may be added to the dispersion medium to impart a charge. The addition may occur at any time during the process; preferably at the end of the process, e.g., after the particulate media, if used, are removed and the concentration of toner particles is accomplished.

According to the method of the invention, the siloxane surfactant is generally added to the developer at any time after the developer has been prepared, but may be added during preparation. The surfactant remains in solution with the developer, and is combined with the toner particles of the developer in such a manner that the surfactant molecules do not react chemically with the toner particles. When the surfactant is added to the developer, it may be mixed or otherwise combined with the developer by any method known in the art. It is a particular advantage of the invention that a developer may be prepared and stored for an indefinite period of time without surfactant, and that the surfactant may be added to the developer when the presence of surfactant is required or advantageous such as, for example, prior to using the developer to form an image.

The invention will further be illustrated in the following non-limiting examples, it being understood that these examples are intended to be illustrative only and that the invention is not intended to be limited to the materials, conditions, process parameters and the like recited herein.

EXAMPLE

A black developer is prepared using the following procedure: In a Union Process 200S attritor, Union Process Company, Akron, Ohio, are placed the following ingredients:

| INGREDIENTS | AMOUNT (lb) |
|---|---|
| Copolymer of ethylene (91%) and methacrylic acid (9%), melt index at 190° C. is 500, acid no. is 54 | 96 |
| Sterling NF carbon black | 22.34 |
| NBD 7010 cyan pigment BASF, Holland, Mich. | 0.46 |
| Aluminum tristearate Witco Chemical Corp., New York, NY | 1.2 |
| Isopar ® L, non-polar liquid having Kauri-butanol value of 27, Exxon Corp. | 950 |

The ingredients are heated to 80° C. and milled with 0.1875 inch (4.76 mm) diameter stainless steel balls for 1 hour. The attritor is cooled to 65° C. while milling is continued. 240 lbs of Isopar ® L are added. The attritor is cooled to 30° C. and 115 lbs of Isopar ® L are added. Milling is continued for six hours. The particulate media are removed and the toner is diluted to 1.5% solids with additional Isopar ® L. To this dispersion is added Nuodex LTD (Huls America, Inc., Piscataway, N.J.) at 1.25% based on the weight of the solids. Basic Barium Petronate (Witco Corp.) is added to give a conductivity of 10 pmhos/cm.

A developer is also prepared as described above except that 450 mg of dimethylsiloxane-ethylene oxide block copolymer (PS071, Petrach Systems, Bristol Pa.) per gram of toner solids is added to the developer.

A photosensitive film consisting of metallized polyethylene terephthalate support, photosensitive layer, and a polypropylene cover sheet, as described in Kempf et al U.S. Pat. No. 4,945,020 is imagewise exposed for 20 seconds through a positive halftone film in emulsion to cover sheet contact in a vacuum frame exposure unit. The coversheet is peeled off the exposed element, and the element is then charged electrostatically. The resulting electrostatic image is toned with the liquid electrostatic developer described above and the toned image is electrostatically transferred from the master to paper. The film is charged with a scorotron having an open grid, spaced 0.5 mm from the element and operated at 250 V and a wire operated at 550 μA. The element is then toned 1.6 seconds after charging using the black developer. The excess toner is removed from the element with a metering roll spaced 0.004 inch (0.10 mm) from the element. The metering roll is biased at 170 V to remove toner from the background non-image areas, and the toner image is transferred to Champion Textweb ® paper 60#, Champion Paper Co., Stanford, Conn. using a combination of a conductive rubber roller, operated at −1.0 kV, and a transfer corotron, operated at +4.0 to +5.5 kV. The paper is placed between the toned element and the conductive rubber roller so the paper is in contact with the toner image. The paper is then passed under the corotron causing the toner image on the element to be transferred to paper. The image is then fixed to paper by fusing at 110° C. for 1 minute.

For the same amount of toner developed onto the element, the control developer gives a density of 0.77 on paper and the example developer gives a density of 1.31, showing a significant increase in transfer efficiency. The improved transfer efficiency is also demonstrated by the transfer of fine lines. The finest lines visible in the control are 30 μm lines, while 15 μm lines are visible in the example. The example images also show less image mottle.

While the invention has been described with reference to particular preferred embodiments, the invention is not limited to the specific examples given, and other embodiments and modifications can be made by those skilled in the art without departing from the spirit and scope of the invention.

What is claimed is:

1. A liquid electrostatic developer which provides high resolution and improved image transfer efficiency comprising a liquid dispersion medium, marking particles and a polymeric siloxane surfactant, wherein said polymeric siloxane surfactant is a siloxane-alkylene oxide block copolymer and is present in an amount effective to improve image transfer efficiency.

2. The developer of claim 1, further comprising a charge control agent.

3. The developer of claim 2, wherein said liquid dispersion medium is an insulating organic liquid dispersion medium.

4. The developer of claim 1, where said marking particles comprise a thermoplastic resin substantially insoluble in the dispersion medium.

5. The developer of claim 3, wherein said thermoplastic resin contains a colorant which is soluble in said thermoplastic resin and insoluble in said dispersion medium.

6. The developer of claim 1, wherein said polymeric siloxane surfactant is:

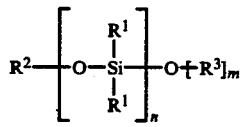

wherein $R^1$ is an alkyl or aryl of 1 to 10 carbon atoms;

$R^2$ is H or alkyl of 1 to 10 carbon atoms terminated with OH;

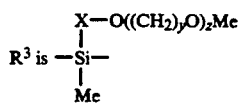

wherein

X is an alkyl of 1 to 50 carbon atoms;

n represents the number of repeating units and is a whole integer from 1 to 200;

m represents the number of repeating units and is a whole integer from 1 to 200;

y is an integer from 1 to 10; and z is an integer from 1 to 30.

7. The developer of claim 1, wherein said polymeric siloxane surfactant is dimethylsiloxane-ethylene oxide.

8. A method of preparing a liquid electrostatic developer which provides high resolution and improved image transfer efficiency comprising adding a polymeric siloxane surfactant to a dispersion comprising a liquid dispersion medium and marking particles, wherein said polymeric siloxane surfactant is a siloxane-alkylene oxide block copolymer and is added in an amount effective to improve image transfer efficiency.

9. The method of claim 8, wherein said dispersion further comprises a charge control agent.

10. The method of claim 8, wherein said liquid dispersion medium is an insulating organic liquid dispersion medium.

11. The method of claim 8, where said marking particles comprise a thermoplastic resin substantially insoluble in the dispersion medium.

12. The method of claim 11, wherein said thermoplastic resin contains a colorant, which is soluble in said thermoplastic resin and insoluble in said dispersion medium.

13. The method of claim 8, wherein said polymeric siloxane surfactant is:

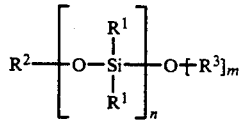

wherein $R^1$ is an alkyl or aryl of 1 to 10 carbon atoms;

$R^2$ is H or alkyl of 1 to 10 carbon atoms terminated with OH;

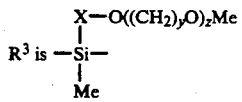

wherein

X is an alkyl of 1 to 50 carbon atoms;

n represents the number of repeating units and is a whole integer from 1 to 200;

m represents the number of repeating units and is a whole integer from 1 to 200;

y is an integer from 1 to 10; and z is an integer from 1 to 30.

14. The method of claim 8, wherein said polymeric siloxane surfactant is dimethylsiloxane-ethylene oxide.

15. The developer of claim 1, wherein the surfactant is present in a concentration ranging from 10 to 1000 milligrams per gram of solids in the developer.

16. The method of claim 8, wherein the surfactant is added to said dispersion in a concentration ranging from 10 to 1000 milligrams per gram of solids in the dispersion.

17. A liquid electrostatic developer which provides high resolution and improved image transfer efficiency, consisting essentially of a liquid dispersion medium, marking particles, and a siloxane-alkylene oxide copolymer, wherein said copolymer is present in an amount effective to improve transfer efficiency.

* * * * *